US011149961B1

(12) United States Patent
Woo

(10) Patent No.: US 11,149,961 B1
(45) Date of Patent: Oct. 19, 2021

(54) PORTABLE RANGE HOOD SYSTEMS AND METHOD OF USE

(71) Applicant: Tommy K. Woo, Fremont, CA (US)

(72) Inventor: Tommy K. Woo, Fremont, CA (US)

( * ) Notice: Subject to any disclaimer, the term of this patent is extended or adjusted under 35 U.S.C. 154(b) by 0 days.

(21) Appl. No.: 17/212,187

(22) Filed: Mar. 25, 2021

Related U.S. Application Data

(60) Provisional application No. 63/003,771, filed on Apr. 1, 2020.

(51) Int. Cl.
*F24C 15/20* (2006.01)
*F23J 11/08* (2006.01)

(52) U.S. Cl.
CPC ..... *F24C 15/2078* (2013.01); *F23J 11/08* (2013.01); *F24C 15/2035* (2013.01)

(58) Field of Classification Search
CPC ..... F24C 15/2078; F24C 15/2085; F24C 15/2092; F23J 11/08
See application file for complete search history.

(56) References Cited

U.S. PATENT DOCUMENTS 2,479,387 A * 8/1949 Matthews ..... A45D 20/44 34/562
3,750,657 A * 8/1973 Lyon ..... A45D 20/00 601/16
5,181,883 A 1/1993 Hofstra et al.
5,188,247 A * 2/1993 Jastrow ..... B66C 23/48 212/257
5,201,860 A * 4/1993 Richardson ..... A01G 29/00 47/39
10,041,687 B1 8/2018 Caneba
2007/0221199 A1* 9/2007 Hake ..... F24C 15/205 126/299 R
2008/0121224 A1* 5/2008 Giles ..... F24C 15/2035 126/299 R (Continued)

FOREIGN PATENT DOCUMENTS

CN 204100349 U 1/2015
EP 2306095 A2 4/2011

OTHER PUBLICATIONS

"30 in. Convertible Kitchen Island Mount Range Hood in Stainless Steel with Circular Tempered Glass Design," www.homedepot.com https://www.homedepot.com/p/AKDY-30-in-Convertible-Kitchen-Island-Mount-Range-Hood-in-Stainless-Steel-with-Circular-Tempered-Glass-Design-RH0481DS/300147828 [date accessed: Mar. 22, 2021].

*Primary Examiner* — David J Laux
(74) *Attorney, Agent, or Firm* — Houda El-Jarrah; Bold IP, PLLC

(57) ABSTRACT

Embodiments are described for a portable range hood system. The portable range hood system can include a replaceable filter and is not connected to a duct. Alternatively, the portable range hood system can be coupled to a duct. The range hood system includes a support frame structure with wheels to make the system portable and capable of being moved to any desired spot. The range hood system includes an exhaust fan and range hood, as well as a filter container housing a filter to filter out any steam, heat, odors, and smoke, including cigarette smoke. The portable range hood system can include a lighting system and plantar box for planting plants, herbs, flowers, or anything that can grow. The portable range hood system can be moved to any location in one's home or business to filter out contaminants and cleanse the surrounding air.

11 Claims, 6 Drawing Sheets

(56) References Cited

U.S. PATENT DOCUMENTS

| | | | | |
|---|---|---|---|---|
| 2008/0202491 | A1* | 8/2008 | Eberhard | B01D 46/0002 126/299 D |
| 2011/0028079 | A1* | 2/2011 | Dieter | F24C 15/2042 454/193 |
| 2012/0204855 | A1* | 8/2012 | Huber | F24C 15/2035 126/299 R |
| 2017/0115009 | A1* | 4/2017 | Ramphos | F24C 15/2042 |
| 2018/0289217 | A1* | 10/2018 | Stollenwerk | A47J 37/1276 |
| 2019/0285344 | A1* | 9/2019 | Hammond | F26B 21/001 |

* cited by examiner

PORTABLE RANGE HOOD SYSTEMS AND METHOD OF USE

CROSS-REFERENCE TO RELATED APPLICATIONS

This application is a non-provisional application which claims priority to U.S. Provisional Patent Application No. 63/003,771 which was filed on Apr. 1, 2020, which is incorporated by reference in its entirety.

FIELD OF THE DISCLOSURE

The present description relates to one or more portable range hood systems that may be used to filter out unwanted elements in the air. In particular, the present invention relates to one or more portable range hood systems that may be used to filter out odors, steam, heat, and smoke, including cigarette smoke or other undesirable elements in the air. In some embodiments, the portable range hood systems may include a changeable filter, and in other embodiments, may be connectable to a duct that conveys the contaminated air to an outside environment, thereby improving the air quality.

BACKGROUND

Kitchen range hoods are known to filter out unwanted elements in the air, in particular, those elements located in the kitchen that affect the air quality in the kitchen, such as steam, heat, or odors. Kitchen range hoods are also referred to and known as vent hoods or exhaust hoods. Many Chinese restaurants known as "Hot Pot" restaurants include such a kitchen range hood located over each cooking surface in the restaurant in order to remove the excessive steam, grease, or odors that are produced while cooking in the surrounding air. "Hot Pot" restaurants serve a variety of foods that may be cooked in a hot pot soup pot. However, a downside to these kitchen range hoods is that they are not usually portable. Accordingly, such kitchen range hoods cannot be moved to any location to allow a user to filter the air in other parts of the restaurant, house, or other type of building or location.

In addition to removing odors, smoke, steam, grease, and heat, it would be beneficial to be able to cleanse the air of cigarette smoke. Unfortunately, most locations where people are allowed to also smoke do not have portable vent hoods and/or exhaust fans to assist in cleansing the air. For example, if people are congregated in a location with a great deal of cigarette smoke, the kitchen range hood will not be beneficial in filtering the cigarette smoke because it is not moveable to this location and may be located in an entirely other section of the restaurant, house, or other type of building or location.

Accordingly, there is a need for a portable range hood that may also be adjustable in its height. Further, it may be desirable for a portable range hood that may include a planter box for growing plants and other vegetables, herbs, fruits, flowers, bonsai trees, etc. In addition, it is desirable for a portable range hood system that may be easily connectable to either a duct that can vent the air outside or that includes a changeable filter that can filter out the air and be changed regularly as needed. Further, it is desirable to have a range hood with a circular shaped design that is less bulky and more attractive in appearance than the standard rectangular shaped range hoods.

SUMMARY

Embodiments are described for a portable range hood system. In one or more non-limiting embodiments, the portable range hood system may include a filter container having a filter. The filter may be configured to filter out steam, heat, odors, and smoke, including cigarette smoke. The portable range hood system may further include an exhaust fan, whereby the exhaust fan connects to the filter container and the filter. The portable range hood system may further include a range hood, whereby the range hood is positioned beneath the exhaust fan and is configured to draw contaminated air up through the range hood and into the exhaust fan to the filter container. The portable range hood system may further include a support structure coupled to the range hood and wheels. The wheels may be connected to a bottom surface of the support structure, whereby the wheels are configured to allow the portable range hood system to be positioned in any location to filter out unwanted contaminants in air. In one or more non-limiting embodiments, a height of the support structure is adjustable.

Further, in one or more non-limiting embodiments, the support structure includes a top support beam, two side support beams, and a central support beam. In one embodiment, the exhaust fan is connected to the top support beam and the central support beam connects to a central portion of the range hood. Further, the two side support beams and the central support beam may be adjustable in height. Additionally, the wheels may be connected to the bottom surfaces of each of the two side support beams and also to the central support beam. In contrast to common designs for most range hoods, the range hood may be circular in shape. Additionally, in a non-limiting embodiment, the filter is removable and exchangeable.

In another non-limiting embodiment, the portable range hood system may further include a light box and a planter box, whereby the planter box is positioned a distance beneath the light box. The planter box may be used for growing plants, vegetables, fruits, or flowers. In some embodiments, the portable range hood system may include a replaceable, exchangeable filter. In other embodiments, the portable range hood system is configured to be coupled to a duct at an establishment. Further, the portable range hood system can be uncoupled from the first duct and coupled to another duct located either in a same establishment or another establishment.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
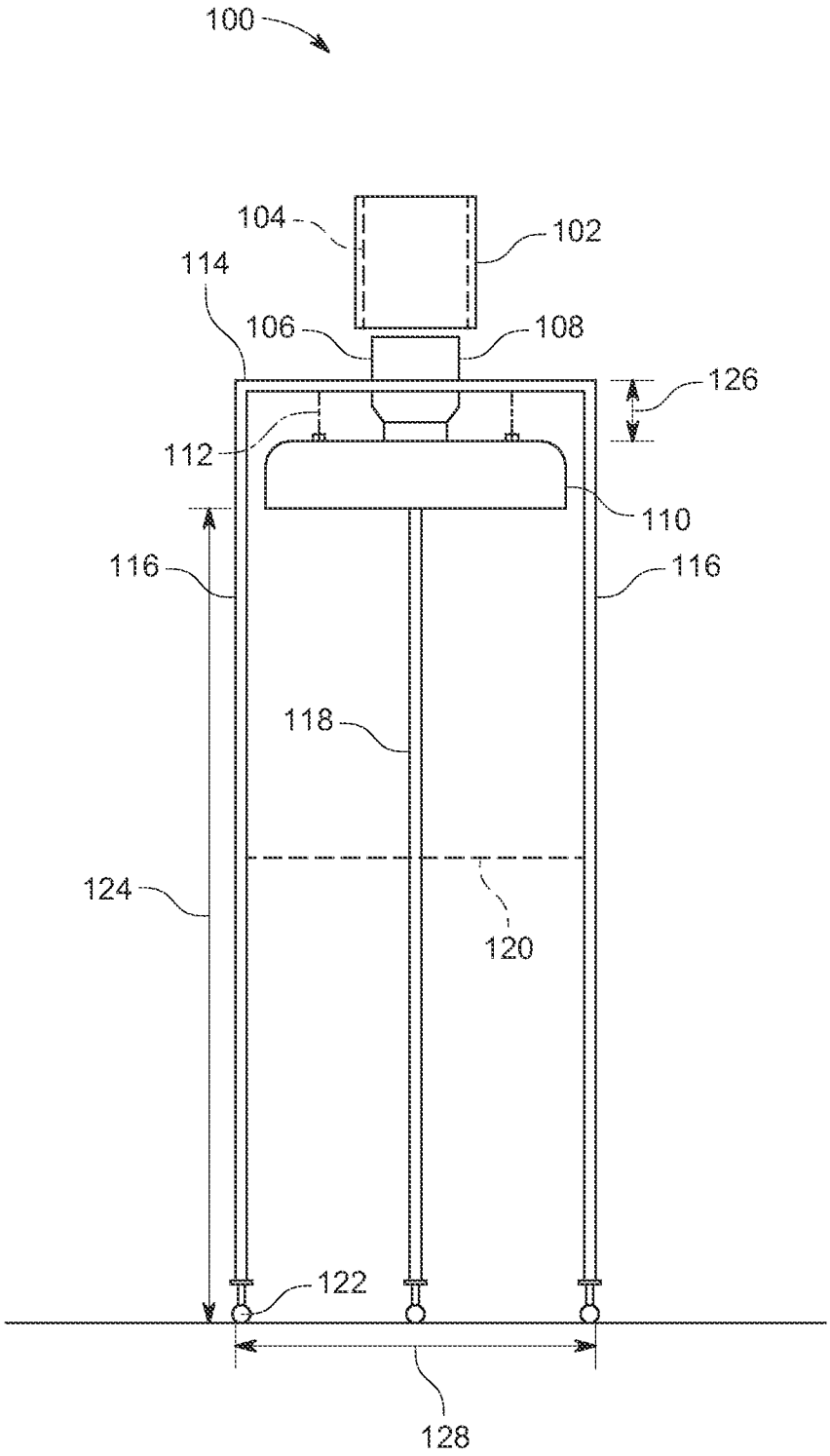
FIG. 1 is a pictorial illustration of a portable range hood having a removable filter in accordance with an illustrative embodiment.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure is generally drawn to various embodiments for a portable range hood. In one or more non-limiting embodiments, the portable range hood may be used to improve the air quality in a restaurant, house, building, or any other type of location without limitation. The portable range hood, in one or more non-limiting embodiments, may be used to filter out and reduce or remove unwanted elements in the air, including, but not limited to, heat, steam, odors, and smoke, including cigarette smoke. Further, one or more embodiments may allow a portable range hood system to be connected to an existing duct in order to convey the contaminated air in a space outdoors.

Other embodiments relate to a non-portable, improved range hood that may be connected to a duct so that any unwanted contaminants may be conveyed from an interior location, through the range hood, through the connected duct, and then into an outside air environment. Further details are provided below.

Turning to FIG. 1, FIG. 1 is a pictorial illustration that displays an example of a portable range hood. The portable range hood system 100 of FIG. 1 may include a number of components. In one or more non-limiting embodiments, a portable range hood system 100 may include a filter container 102. The filter container 102 may be configured to hold a filter 104. Filter 104 may be removable and exchangeable regularly by the user. An example of such a filter 104 is a mesh type filter which can be regularly replaced by the user. That being said, filter 104 is configured to be any type of filter known in the art that is capable of filtering out heat, steam, and odors. Filter 104 may be able to filter out other unwanted elements in the air, including viruses, moisture, chemicals, or any other type of element. In particular, filter 104 is useful for filtering out any type of smoke, including harmful cigarette smoke.

The term "range hood" throughout this present description may interchangeably be used and may also mean the same as a "vent hood" or "an exhaust hood." Further, the "range hood" as described throughout the description and shown in FIGS. 1-6B may be used in any location in any type of place or building, regardless of whether a "range hood" is positioned in a kitchen or not. The term "range hood" is functionally the same as a "vent hood" or "exhaust hood" as understood by one of ordinary skill in the art.

In one or more non-limiting embodiments, filter 104 may be a charcoal type filter. Any other materials and elements may be included in filter 104 other than charcoal. Filter 104 may be regularly changeable and removable by a user based on a recommended duration or period of use for each filter 104. Filter 104 may be any type of filter known in the art.

In one or more non-limiting embodiments, filter container 102 may be positioned above an exhaust fan body 106 that contains exhaust fan 108. Exhaust fan 108 is a type of fan that may be useful to pull the unwanted odors, fumes, heat, steam, grease, and smoke from any area of any location, including, one's home, a restaurant, a workspace, or any other type of location. Exhaust fan 108 is an exhaust fan, as known in the art, that is able to vent these unwanted elements into the exchangeable or removable filter 104. Once the filter 104 removes these elements, the air is recirculated back into the surrounding environment in a cleaner state than before.

Exhaust fan 108 may use a motor in one or more non-limiting embodiments, to turn its blades which function to pull air out of the space and propel the polluted or contaminated air into the exhaust fan 108 and towards the changeable filter 104. In one or more non-limiting embodiments, exhaust fan 108 is capable of moving at least 100-300 cubic feet per minute (CFM) of air. In other embodiments, exhaust fan 108 may be capable of moving a greater or lesser amount of air based on the CFM measurement.

Range hood 110 may be a type of range hood that draws up the contaminated air from a space when exhaust fan 108 is activated. Range hood 110 and exhaust fan 108 may function, in one or more non-limiting embodiments, in portable range hood system 100 as a ductless range hood as known in the art. A ductless range hood (e.g., range hood 110) may be configured to draw contaminated air into a filter, such as filter 104, and recirculate the filtered air into the same space. A ductless range hood, such as range hood 110 is not connected to a duct, such as duct 302 shown in FIG. 3. The duct 302 shown in FIG. 3, is capable of circulating contaminated air upwards and outwards into an outdoor environment, such as outdoor environment 304. Accordingly, the range hood 110 shown in FIG. 3 is not a ductless range hood unlike the range hood 110 shown in FIGS. 1-2. The range hood 110 may be circular shaped, as shown in FIG. 1, in one or more non-limiting embodiment.

Range hood 110 may be made of any material known to those of ordinary skill, including without limitation, any type of metal. In one or more non-limiting embodiments, range hood 110 may be circular in shape, although any other desired shape may alternatively be used for the shape and structure of range hood 110. Further, range hood 110 may have any dimensions as needed, but in one non-limiting embodiment, range hood 110 may be 30 inches in diameter.

The body of the range hood 110 may contain air and direct the air upwards through the exhaust fan 108 and then through the connected filter 104 that is located in the filter container 102, as shown in FIG. 1.

In one or more non-limiting embodiments, the filter 102, filter container 104, exhaust fan 108, and range hood 110 are made portable by their connection to the support structure of the portable range hood system 100. The support structure may include, without limitation, a top support beam 114, two side support beams 116, and a central support beam 118. Top support beam 114, side support beams 116, and central support beam 118 may also be described or referred to as "legs."

As shown in FIG. 1, in one or more non-limiting embodiments, the top support beam 114 may be connected to the exhaust fan body 106 which contains the exhaust fan 108. Further, the top support beam 114 may be connected or attached to the range hood 110. In one or more non-limiting embodiments, the range hood 110 may be suspended from the top support beam 114 via one or more hood hanging members 112. Such hood hanging members 112 may be chains or may be any other type of device used to hang range hood 110.

One or more side support beams, such as side support beams 116 may be located on either side of the top support beam 114. Side support beams 116 may be fixedly attached to the top support beam 114. Further, in one or more non-limiting embodiment, there may be a central support beam 118 extending from the center of the top support beam 114 down to a ground level. In one or more non-limiting embodiments, there may be a chain support member, such as chain support member 120 that extends between each side support beam 116.

In one or more preferred embodiments, top support beam 114, side support beams 116, central support beam 118, and chain support member 120 may all be made of steel. However, any other type of metal or any other type of material may also be used as an alternative to steel or in addition to steel.

In one or more non-limiting embodiments, a wheel, such as wheel 122 is fixedly attached to the bottom of each of the side support beams 116 and to the central support beam 118. Wheels 122 may also be referred to herein as casters or rollers. Wheels 122 are configured to move and rotate in any direction, whereby the inclusion of wheels 122 allows the range hood system 100 to be portable and movable as a whole unit. Advantageously, a user is able to move and position the range hood system 100 to any needed location in order to filter out (e.g., using the filter 104 and exhaust fan 108) the unwanted elements contaminating the air in that space. When not in use, the portable range hood system 100 may be stored anywhere that is convenient.

In one or more non-limiting embodiments, the distance 124 from the ground to the bottom level of the kitchen range hood may be 6 feet in height. The distance 126 from the ground to the top support beam 114 may be 7 feet in height. Further, the distance 128 between each of the side support beams may be 34 inches in width. Those of ordinary skill in the art understand that these numbers are non-limiting and any other dimensions for the height or width are also feasible. Further, in one or more non-limiting embodiments, the range hood system 100 may be adjustable in height so that the side support beams 116 and the central support beam 118 may be either raised or lowered to a height desirable to the user.

Figure 2:
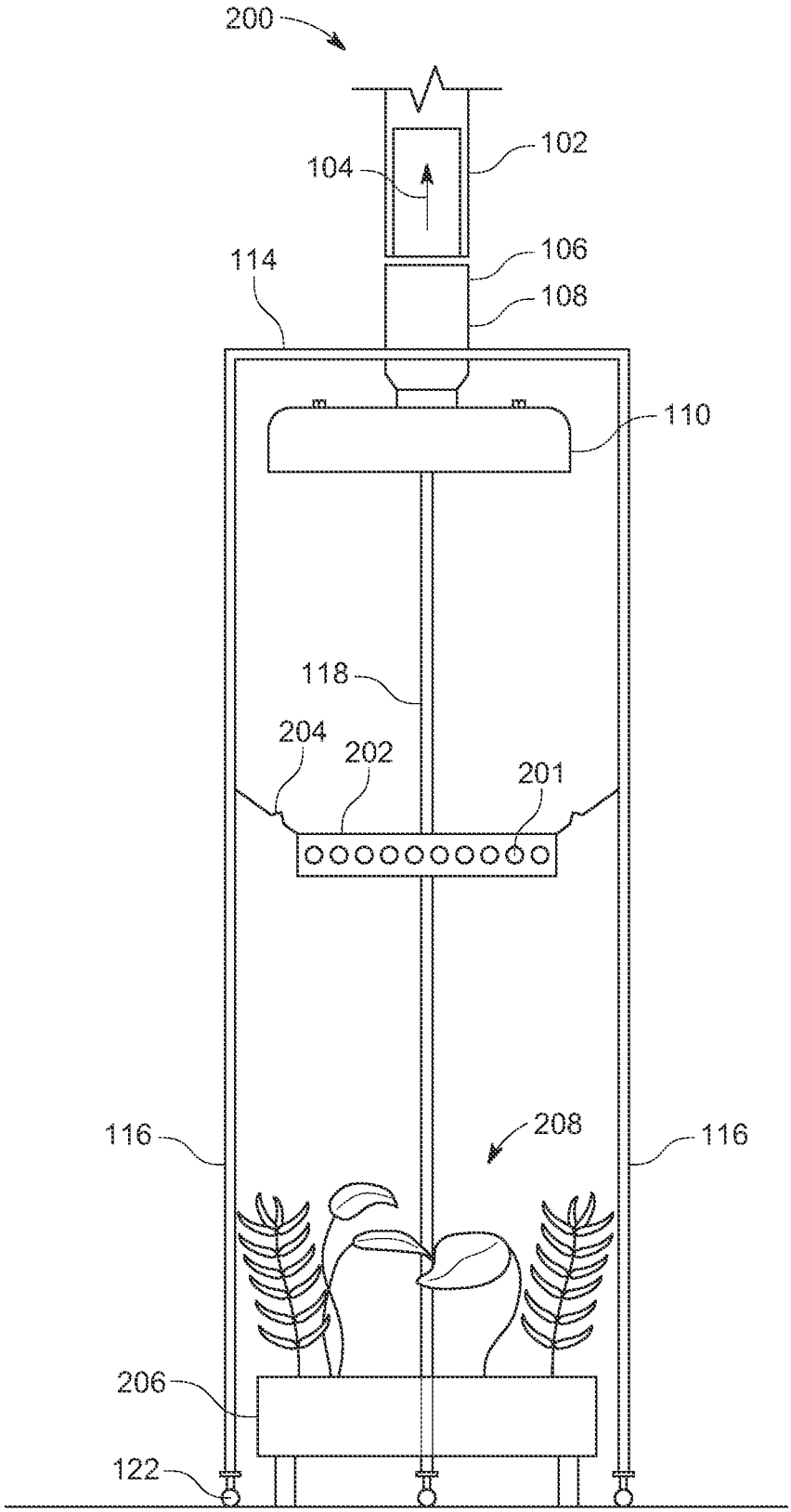
FIG. 2 is a pictorial illustration of a portable range hood having a removable filter, a light box, and a planter box in accordance with an illustrative embodiment.
Figure 3:
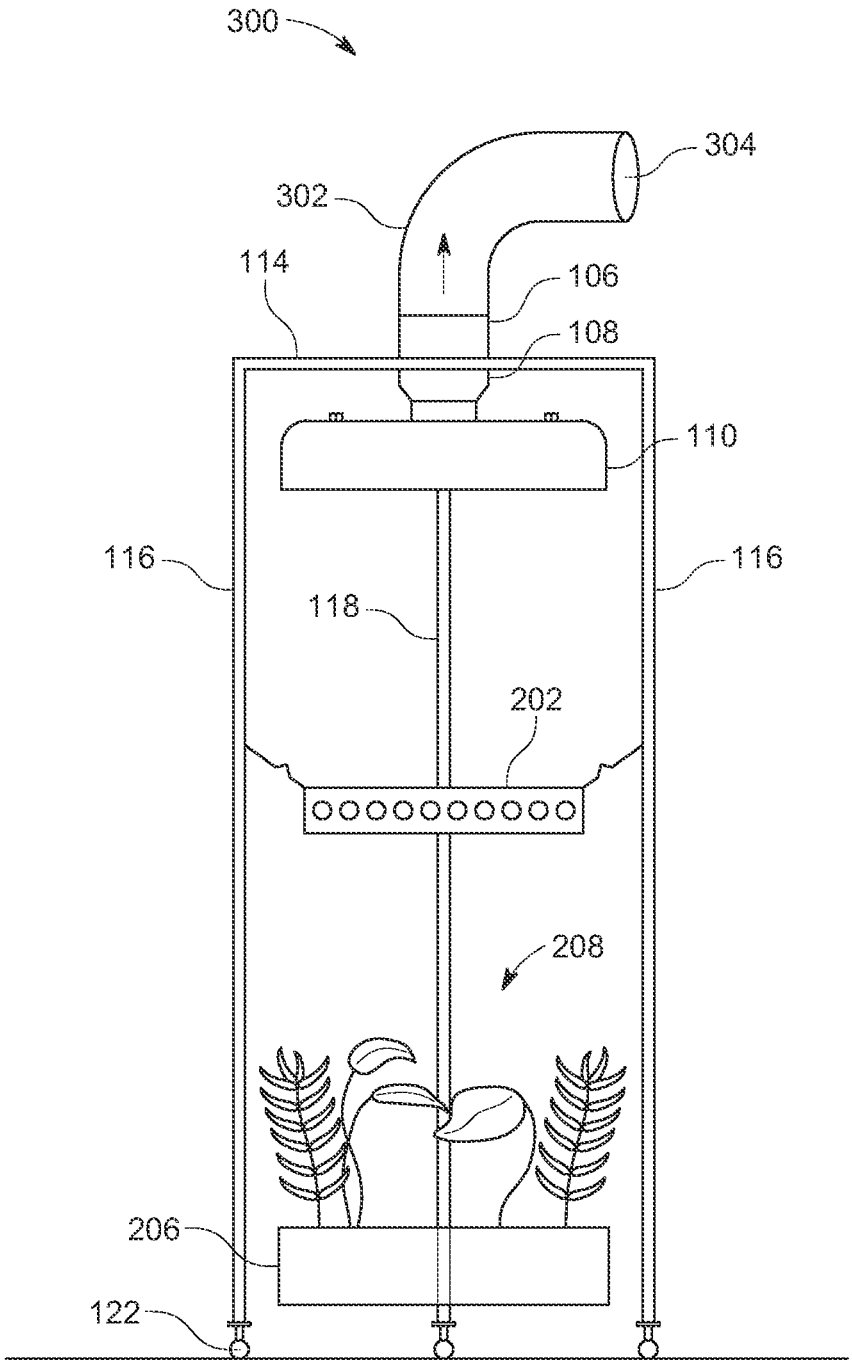
FIG. 3 is a pictorial illustration of a portable range hood connected to a duct system for conveying contaminated air outside in accordance with an illustrative embodiment.

Turning to FIG. 2, FIG. 2 shows an embodiment of portable range system 200. Portable range system 200 is similar to the portable range hood system 100 as described and shown in FIG. 1, but portable hood system 200 also includes a container (e.g., planter box 206) for growing plants, fruits, vegetables, herbs, flowers, or any other desired growing entity 208.

In one or more non-limiting embodiments, the portable range hood system 200 includes all of the listed components and features of the portable range hood system 100. Thus, there is an exhaust fan 108 located in an exhaust fan body 106 capable of drawing up contaminated air through the range hood 110, then through the exhaust fan 108, and into the filter 104 located in the filter container 102. Further, the range hood 110 is made portable due to the support structure which includes a top support beam 114, two side support beams 116, a central support beam 118, and wheels 122. While not shown in FIG. 2, in one or more non-limiting embodiments, there may also be a support member 120 positioned and extending between each side support beam 116.

In addition to the above, portable range hood system 200 includes a planter box such as planter box 206. Planter box 206 is a container configured to hold and grow any plants or other types of growing entities 208. Such growable entities 208 may include, but are not limited to, herbs, fruits, vegetables, and/or flowers, as well as any type of plant or vegetation as mentioned above. In a non-limiting embodiment, plantar box 206 may be used to grow plants such as marijuana plants. Planter box 206 may be positioned between each side support beam 116. In one or more non-limiting embodiments, the central support beam 118 may extend through and connect with fasteners or the like to the center portion of the planter box 206. Alternatively, or additionally, planter box 206 may also be attached to the side support beams 116 to further stabilize and hold planter box 206 in place.

Planter box 206 may be shaped in a generally rectangle shape as shown in FIG. 2 or may alternatively be formed as having any other shape and dimensions as desired. Further, planter box 206 may include a cavity inside, whereby a user may include the necessary components for growing his or her preferred plants or other types of growing entities 208. This may include the use of soil, fertilizer, water, seeds, bulbs, and any other items or components useful for growing plants or other vegetation 208.

In one or more non-limiting embodiments, a light box, such as light box 202 may be located some distance above planter box 206. The light box 202 may include, without limitation, one or more light emitting diodes (LEDs) such as light emitting diodes 201. Any other type of light may be used in alternative embodiments or in addition to LEDs 201.

Further, the light box 202 may be fixedly attached to the side support beams 116 and to the center support beam 118 in one or more non-limiting embodiments. For example, suspension members 204 (which may be a strong type of wire or cable or a chain or other type of device) may be used to attach and connect the light box 202 to each side support beam 116.

Advantageously, including the planter box 206 provides a convenient location for the user to grow his or her plants or other growing entities 208. Further, the exhaust fan 108 and filter 104 can filter any unwanted odors produced by the growing plants and other growing entities 208 such as from odorous plants and fruits and vegetables. Examples of odorous plants may include, but is not limited to, marijuana plants. Also, growing entities 208 may make the portable range hood system 200 a more decorative and attractive piece to include in a location.

Advantageously, range hood system 200 is also portable and can be moved to any space or location as desired by the user. In one or more non-limiting embodiments, the filter 104 of range hood system 200 may also be capable of filtering out smoke (including cigarette smoke), steam, heat, grease, and unwanted contaminants in the air. Further, filter 104 can filter out, alleviate, or remove entirely unwanted odors that come from cooking or smoking or any other source of odor, including pets, plants, or mustiness.

In both portable range hood system 100 and 200, filter 104 may act to filter out these unwanted elements by generally trapping them inside the body of the filter. The purified air is then free to circulate out of the filter 104 and back into the space or location where the portable range system 100 and 200 are located. This is due to the ductless range hood systems 100 and 200 used and shown in FIG. 1 and FIG. 2.

Turning to FIG. 3, FIG. 3 shows another type of portable range hood system, in particular, portable range hood system 300. Portable range hood system 300 differs from the portable range hood systems 100 and 200 shown in FIG. 1 and FIG. 3, respectively, because portable range hood system 300 includes a duct, such as duct 302. Duct 302 is a tube or passageway in the house, restaurant, building, or other location that portable range hood system 300 is located in. Duct 302 allows the contaminated air in these locations to be conveyed through duct 302 and to exit into the outdoor environment 304. The duct 302 may be built into these locations (e.g., house, restaurant, office, workspace, etc.) through one or more walls or ceilings.

In one or more non-limiting embodiments, the top of the exhaust fan body 106 may connect to the opening in the duct 302. The exhaust fan 108 and kitchen range hood 110 in portable range hood system 300 may function in accordance with the exhaust fan 108 and kitchen range hood 110 as described above in FIG. 1 and FIG. 2. Accordingly, exhaust fan 108 and kitchen range hood 110 draw up contaminated air having unwanted elements (e.g., such as steam, heat, odors, smoke) through the range hood 110 and exhaust fan 108 and out through the duct 302 to the outside surrounding environment 304. Beneficially, the air exits outside 304 so that the air located inside is cleaner and has less unwanted elements.

In one or more non-limiting embodiments, the portable range hood system 300 includes a light box, such as light box 202 and a planter box 206. Alternatively, the light box 202 and planter box 206 may be omitted such that portable range hood system 300 is similar to portable range hood system 100 shown in FIG. 1 while also being connectable to the pre-existing duct 302 and to the outside environment 304.

The embodiment shown in FIG. 3 might be even more attractive to users in restaurants and other locations that want to ensure any polluted or contaminated air may be conveyed outside so as to make sure the air quality indoors is as fresh and clean as possible and includes a reduced amount of odors, heat, steam, or smoke, including cigarette smoke. The range hood system 300 shown in FIG. 3 is still intended to be portable and thus the user may attach and detach the portable range hood system to the duct 302 or to another duct located in the establishment or another establishment anytime the user desires.

Accordingly, the one or more components included in portable range hood systems 100, 200, and 300 as shown in FIG. 1, FIG. 2, and FIG. 3, respectively, may act to reduce and/or remove entirely any contaminants in the surrounding air. Portable range hood system 100 (as well as system 200 shown in FIG. 2 and system 300 shown in FIG. 3) may be used in any residential or commercial establishment, without limitation, as well as any indoor or outdoor environment.

Figure 4:
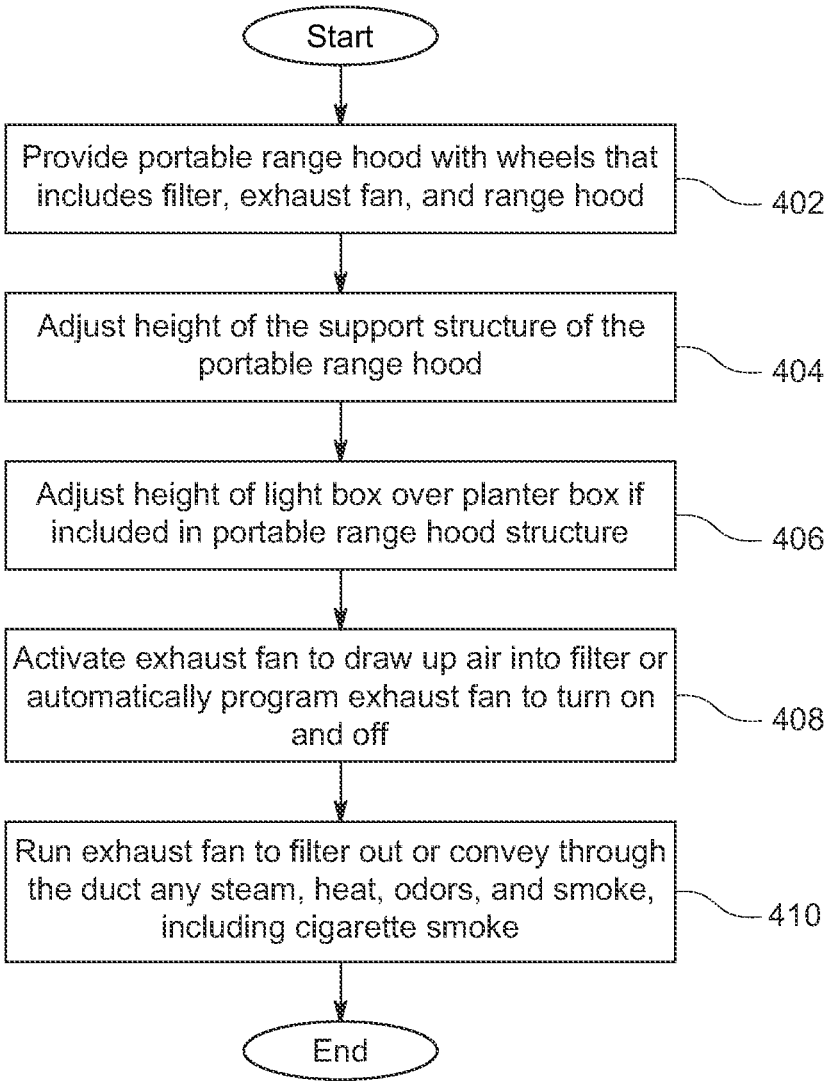
FIG. 4 is a flowchart of an exemplary method of use of a portable range hood in accordance with an illustrative embodiment.

Turning to FIG. 4, FIG. 4 is a flowchart of an exemplary method for using a portable range hood system, such as portable range hood systems 100, 200, and 300 as shown in FIG. 1, FIG. 2, and FIG. 3.

At step 402, the process may commence with providing a portable range hood system (e.g., 100, 200, and 300) having wheels (e.g., wheels 122). Further, the portable range hood system may include a filter 104 and/or exhaust fan 108 and a range hood 110. A user may position such a portable range hood system (e.g., 100, 200, and 300) anywhere desired in any location. In case there is a duct attachment, in one or more non-limiting embodiments, the user may need to connect or attach the portable range hood system (e.g., 300) to an existing duct, such as duct 302 that connects to the outdoor environment 304 and conveys any unwanted contaminated air to the outdoor environment 304.

Continuing with step 404, the user may adjust the height of the support structure of the portable range hood system to the desired height. At step 406, if a light box, such as light box 202 is included and a planter box, such as planter box 206, the user may adjust the height and position of the light box 202 over the planter box 206.

Next, at step 408, an exhaust fan, such as exhaust fan 108 may be activated to draw up the contaminated air into either the filter 104, such as when using portable range hood system 100 shown in FIG. 1 or portable range hood system 200 shown in FIG. 2 or the duct 302, such as when using portable range hood system 300 shown in FIG. 3. In other embodiments, the exhaust fan 108 may be configured to activate automatically and may be programmed to turn on and to shut off after a particular period of time. At step 410, the exhaust fan 108 is allowed to run for a particular period of time to filter out to the filter 104 or to convey out through the duct 302 any steam, heat, odors, or smoke, including cigarette smoke. Thus, the portable range hood systems 100, 200, and 300 as described above may greatly assist in improving the air quality indoors, outdoors, and anywhere a user desires to have a portable range hood system, such as portable range hood systems 100, 200, and 300.

As noted above, there are multiple benefits that are provided from the one or more embodiments of the portable range hood systems (e.g., 100, 200, and 300) as described above. One of ordinary skill in the art may envision additional methods of use and advantages as well.

Figure 5:
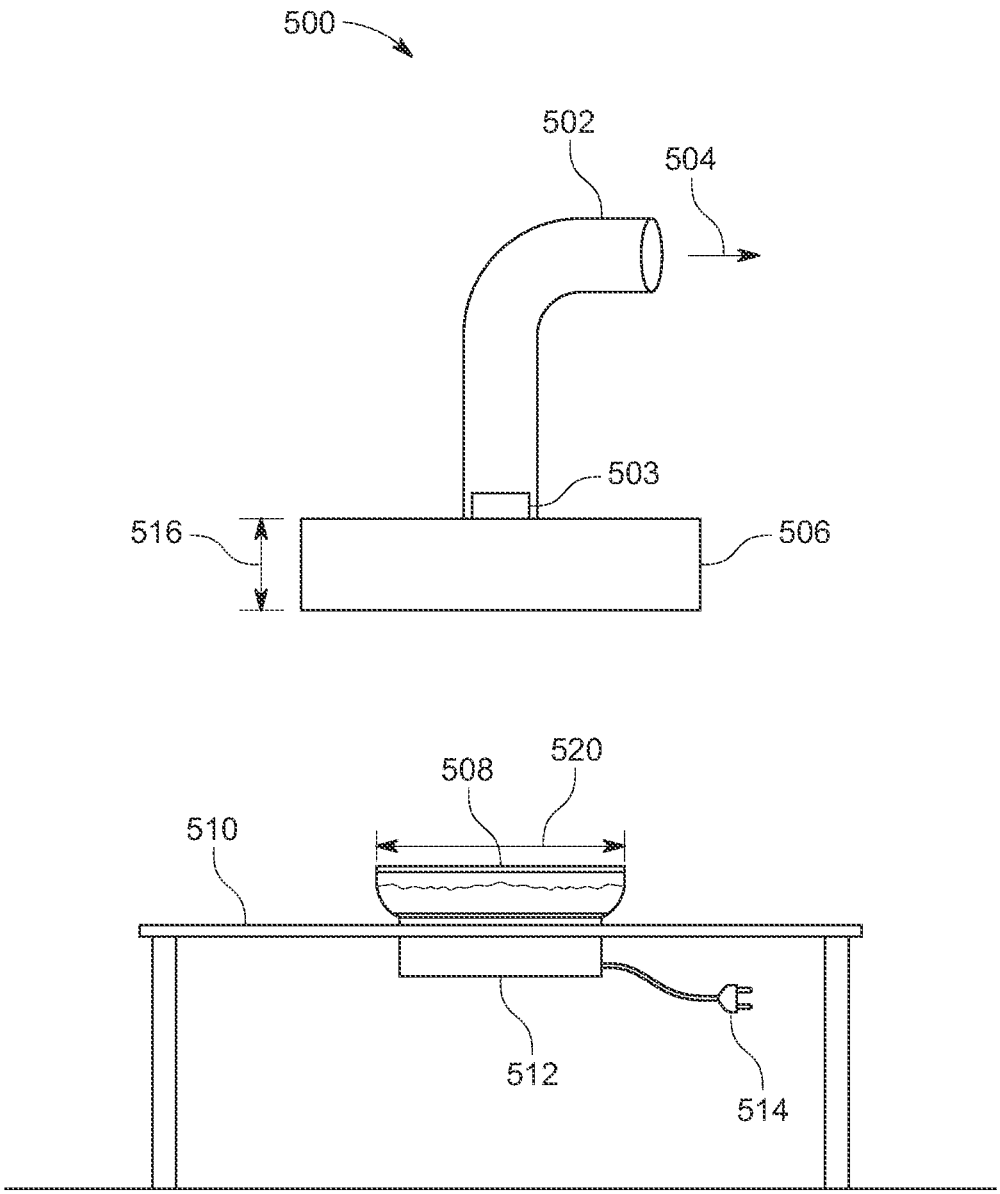
FIG. 5 is a pictorial illustration of an exemplary range hood and induction cooker in accordance with an illustrative embodiment.

FIG. 5 is a pictorial illustration of an exemplary range hood and induction cooker in accordance with an illustrative embodiment. In one non-limiting embodiment, the present description includes an improved system for a range hood to be used in a restaurant or other type of establishment or location serving food. In particular, the system 500 shown in FIG. 5 may be particularly helpful and useful in one or more restaurants in which customers are provided with equipment to cook their own food, such as in restaurant with an open cooking source at each table, including, a Hot Pot soup pot 508 shown in FIG. 5. Such places include, but are not limited in application to, Hot Pot style restaurants. Other similar types of restaurants where such as system 500 may be useful are hibachi style restaurants or any restaurants that grill to a great extent.

Many problems exist with current cooking systems in Hot Pot and other restaurants. First, most Hot Pot restaurants currently have large rectangular kitchen range hoods over each dining table in the Hot Pot restaurant. A problem with these existing rectangular kitchen range hoods is that they are not very visually appealing and do not look nice in the dining rooms over each dining table. Additionally, most cooking ranges including in the dining tables of these restaurants are gas type cookers. In order to meet fire and other safety and regulatory codes, a sprinkler system has to be connected or located over each dining table having such a gas cooker. System 500, as shown in FIG. 5, may help alleviate such problems and offers improvements over these existing cooking systems.

In one or more non-limiting embodiment, the cooking system 500 may include a duct 502 that connects with an exhaust fan, such as exhaust fan 504. Duct 502 allows unwanted elements in the air, such as steam, heat, odors, smoke, or other unwanted elements, to be transported away from the interior of the restaurant or location of system 500 and through duct 502 to an outside environment.

In one or more non-limiting embodiments, range hood 506 is also connected to the duct 502. The range hood 506 may be a range hood that removes steam, odors, heat, and smoke in the surrounding environment. It may be turned on when in use and off when not needed.

Figure 6A:
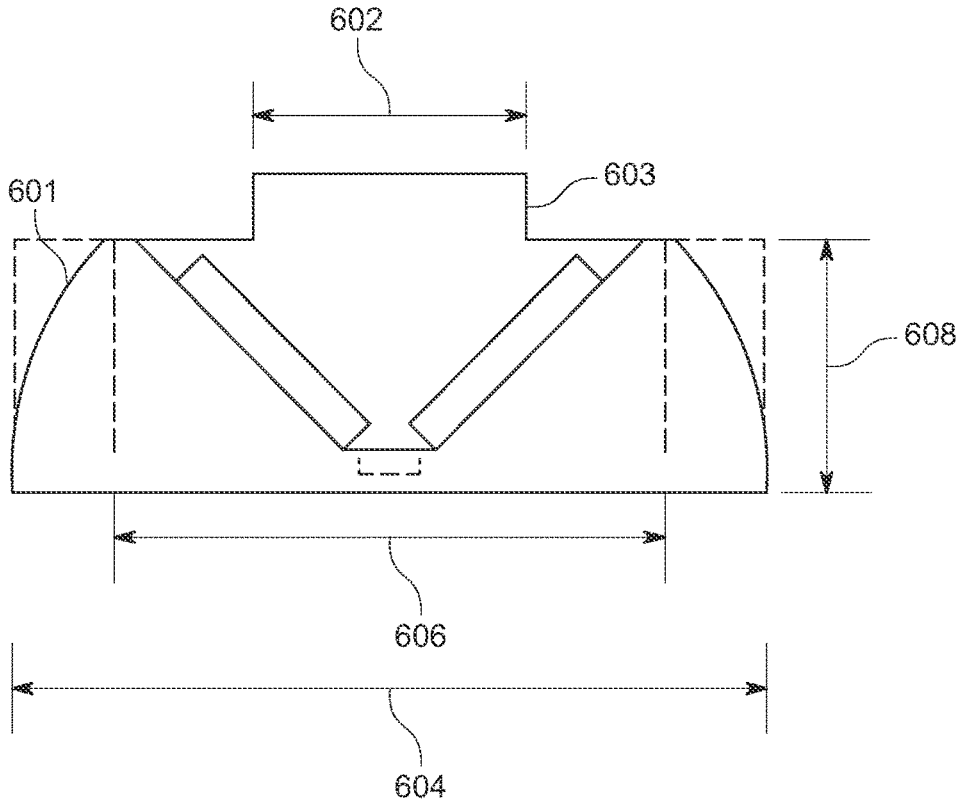
FIG. 6A is a pictorial illustration of a front view of an exemplary circular range hood having a filter in accordance with an illustrative embodiment.
Figure 6B:
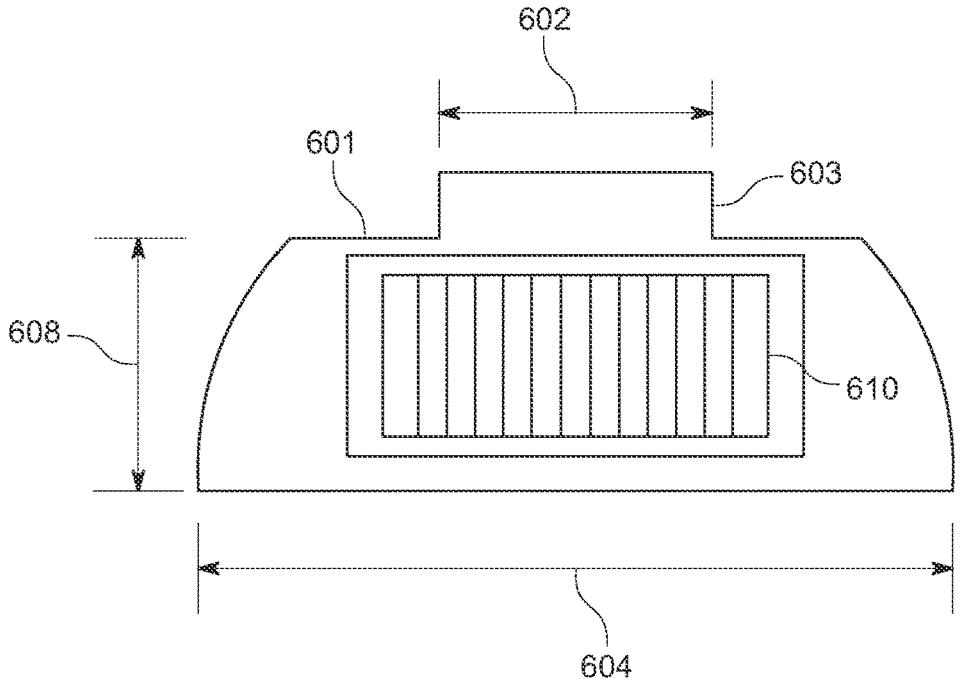
FIG. 6B is a pictorial illustration of a side view of the exemplary circular range hood shown in FIG. 6A in accordance with an illustrative embodiment.

Preferably, range hood 506 may be circular shaped. FIGS. 6A-6B show a non-limiting preferred embodiment of range hood 506 and shows the circular shaped hood. This circular shaped range hood 506 may be more visually appealing and used anywhere to decorate a dining room in a nicer fashion than the existing square or rectangle shaped kitchen range hoods.

Range hood 506 may include a damper, such as damper 503. Damper 503 may open when range hood 506 is activated to allow for air flow. Further, damper 503 may close when range hood 506 is turned off. Damper 503 may assist to prevent back drafting and helps to keep any large debris from getting into ductwork 502 or into range hood 506. Damper 503 may be located on top of range hood 506 and also be connected to duct 502.

In one or more non-limiting embodiments, range hood 506 may remove steam, heat, or other elements at a rate of at least 200 to 300 CFM or more. One of ordinary skill knows that this is an example rate and other rates are also within the scope of the invention.

It is noted that range hood 506 may be suitable for commercial use and can meet any codes of any regulatory agency or department, including all local, state, or federal regulatory departments. Range hood 506 may also be suitable for residential use.

System 500 may also include an induction cooker, such as induction cooker 512. In one or more non-limiting embodiments, induction cooker 513 is built in or otherwise attached to a dining table, such as dining table 510. The induction cooker 512 may be used to cook food contained in a hot pot or other type of soup pot 508. An advantage of having an induction cooker, such as induction cooker 512, is that a sprinkler system does not have to be overhead each table having an induction cooker 512, which is not the case when using a gas cooker.

The induction cooker 512 may be connected to a power source 514 or have its own built in power source 514 (e.g., batteries). Further, induction cooker 512 may be level with the surface of dining table 510.

In one or more non-limiting embodiments, the range hood 506 may have a 26 inch minimum diameter 518. The height of the range hood 506 may be at least 6 inches in height 516. Further, in one or more non-limiting embodiments, the diameter 520 of the soup pot 508 may be at least 12 inches in diameter. Additionally, in one or more non-limiting embodiments, the range hood 506 may be at least 68" above the surface of the dining table 510. It is noted that any other sizes may be used in other embodiments for any of these listed dimensions. Further, any materials may be used to make one or more components of system 500. Nevertheless, it may be preferable, in one or more non-limiting embodiments, for the range hood 506 and the soup pot 508 to be made of steel for durability and quality.

System 500 may be used for any type of cooking establishment. For example, system 500 may be particularly beneficial in a Hot Pot type restaurant as mentioned above. Further, system 500 may be particularly beneficial and useful in a crepe style restaurant that makes crepes of any kind.

FIG. 6A shows a front view of an exemplary range hood 506, and FIG. 6B shows a side view of an exemplary range hood 506. The range hood 506 shown in FIGS. 6A-6B has a filter 610 located inside of the range hood 506. Filter 610 may be any type of useful filter as known in the art. In some embodiments, this may include a HEPA filter.

In a non-limiting embodiment, the filter 610 can be a baffle type filter. A baffle type filter is often used in commercial cooking at commercial cooking establishments, such as restaurants and commercial kitchens. Baffle filters are constructed by interlocking baffles with a tortuous route, through which the grease passes. The oil particles follow down the smooth surface of the filter's vanes and collect within the canopy holding casings. This design limits the chance of build-ups of oil and grease that will prevent the airflow. Baffle filters typically orient the collected oil and grease in a cup or other container that can be emptied and cleaned regularly.

Another common type of filter is a mesh filter. Mesh filters are more commonly used in home cooking environments and kitchens. Mesh filters are usually flat shaped filters that are replaceable. In one or more non-limiting embodiments, if range hood 506 is being used for a commercial kitchen or commercial establishment (e.g., a Hot Pot restaurant), the filter 603 may be a baffle type filter. In one or more non-limiting embodiments, if range hood 506 is being used for a residential kitchen and home cooking environment, it may be preferable for the owner and for the ease of use in easily replacing a mesh type filter rather than having to worry about using a baffle type filter and correctly disposing of the oil that has dripped off into the collection container from the baffle filter.

In one or more non-limiting embodiments, the neck 603 of the range hood 506 may connect to another component in the system 500, such as duct 502 shown in FIG. 5 that draws any unwanted air to the outside environment. If used in a home environment, the neck 603 of the range hood 506 may instead connect to a duct in a home environment, such as duct 302 shown in FIG. 3. The diameter 602 of the neck 603 of the range hood 506 may be at least 12 inches wide in one or more non-limiting embodiments. The width 604 of the entire range hood 506 may be at least 36 inches wide in one or more non-limiting embodiments, while the width 606 of the filter 610 may be at least 26 inches wide. Further, the height 608 of the range hood 506 may be at least 12 inches high in one or more non-limiting embodiments in a commercial establishment. In a residential environment, it may be preferable that the height 608 of the range hood 506 is 6 inches or less in height.

The filter 610 may help remove any unwanted contaminants in the air, such as steam, heat, and/or odor whether the range hood 506 is used in a home environment or a commercial environment. If the filter 610 is not utilized, the entire cooking area may be very steamy and filled with hot air.

The filter 610 may be either a baffle type filter or a mesh type filter as discussed above. If the filter 610 positioned inside of the range hood 506 is a baffle type filter, the filter 610 may be able to move up to 1000 cubic feet of air flow per minute (CFM) in a non-limiting embodiment. If the filter 610 is utilized in a residential environment, the range hood 506 and filter 610 may be able to move up to 400 CFM of air.

Advantageously, system 500 is designed so that one does not need to have a large, extensive kitchen so system 500 may help smaller cooking establishments and be more affordable to set up rather than conventional restaurants that have large kitchens and large dining rooms. Range hood 506 may be more visually appealing having its circular shape (e.g., as shown in FIGS. 6A-6B). Range hood 506 may be smaller than conventional rectangular or other shaped range hoods. Further, a user may include more of them in a smaller space and the addition of the induction cooker, such as induction cooker 512 may assist in a better cooking environment 500. Further, the range hood 506 is more visually appealing with its circular shape, as shown in FIGS. 6A-6B, because the range hood 506 is not a bulky, rectangular range hood that are the conventionally seen range hoods.

One of ordinary skill in the art may understand the many benefits and advantages provided by the one or more portable range hood systems 100, 200, and 300 as shown in FIGS. 1-3. A user is not limited to filtering out unwanted elements in the air solely in a kitchen area, which is the conventional location where range hoods are placed. Rather, the user may position the portable range hood systems 100-300 described herein in any location where there is smoke, heat, odors, or any type of contaminant that may be filtered out by the filter located in the portable range hood systems 100-300. Further, the design of the circular range hood 110, as shown in FIGS. 1-3, or circular range hoods 506 as shown in FIGS. 5-6B is more visually appealing and takes up less space. Additionally, the plantar box 206 and light box 202 shown in FIG. 2 may be used to grow beneficial fruits, vegetables, and plants and any odors that emanate from these growing entities can be reduced or eliminated by the filter 104 in the portable range hood system 300. There are many other benefits and advantages provided by the embodiments described herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A portable range hood system, the portable range hood system further comprising:

a filter container, wherein the filter container comprises a filter configured to filter out unwanted air contaminants;

an exhaust fan, wherein the exhaust fan connects to the filter container and the filter;

a range hood, wherein the range hood is positioned beneath the exhaust fan and is configured to direct the unwanted air contaminants air up through the range hood and into the exhaust fan to the filter container;

a light box;

a planter box, wherein the planter box is positioned a distance beneath the light box, wherein the planter box is configured for growing plants, vegetables, fruits, or flowers;

a support structure; and wheels, wherein the wheels are connected to one or more bottom surfaces of the support structure, wherein the wheels are configured to allow the portable range hood system to be positioned in any location to filter out the unwanted air contaminants.

2. The portable range hood system of claim 1, wherein the unwanted air contaminants comprise steam, heat, odors, and smoke, including cigarette smoke, and grease.

3. The portable range hood system of claim 1, wherein a height of the support structure is adjustable.

4. The portable range hood system of claim 1, wherein the support structure includes a top support beam, two side support beams, and a central support beam.

5. The portable range hood system of claim 4, wherein the exhaust fan is coupled to the top support beam.

6. The portable range hood system of claim 4, wherein the two side support beams and the central support beam are adjustable in height.

7. The portable range hood system of claim 4, wherein the wheels are connected to bottom surfaces of each of the two side support beams and also to the central support beam.

8. The portable range hood system of claim 1, wherein the range hood is circular shaped.

9. The portable range hood system of claim 1, wherein the filter is removable and exchangeable.

10. The portable range hood system of claim 1, wherein the portable range hood system is coupled to a duct.

11. The portable range hood system of claim 10, wherein the portable range hood system can be uncoupled from the duct and coupled to another duct located either in a same establishment or another establishment.

* * * * *